US005433588A

United States Patent [19]

Monk et al.

[11] Patent Number: 5,433,588

[45] Date of Patent: Jul. 18, 1995

[54] PERISTALTIC PUMP WITH ONE PIECE TUBING INSERT AND ONE PIECE COVER

[75] Inventors: David E. Monk, Portage; Kris D. Eager, Ross Township, Kalamazoo County; Jerry A. Culp, Oshtemo Township, Kalamazoo County, all of Mich.

[73] Assignee: Stryker Corporation, Kalamazoo, Mich.

[21] Appl. No.: 167,776

[22] Filed: Dec. 15, 1993

[51] Int. Cl.[6] ..... F04B 43/08

[52] U.S. Cl. ..... 417/477.2

[58] Field of Search ..... 417/474, 476, 477 R, 417/477 A, 477 H, 477.1, 477.2, 477.9

[56] References Cited

U.S. PATENT DOCUMENTS

| | | | |
|---|---|---|---|
| 4,239,464 | 12/1980 | Hein | 417/474 |
| 4,548,553 | 10/1985 | Ferster | 417/477 |
| 4,559,040 | 12/1985 | Horres et al. | 417/474 |
| 4,599,055 | 7/1986 | Dykstra | 417/477 A |
| 4,735,558 | 4/1988 | Kienholz et al. | 417/477 A |
| 4,824,339 | 4/1989 | Bainbridge | 417/477 A |
| 4,904,168 | 2/1990 | Cavoto et al. | 417/477 A |
| 4,909,713 | 3/1990 | Finsterwald | 417/477 |
| 5,017,059 | 5/1991 | Davis | 417/474 |
| 5,230,614 | 7/1993 | Zanger et al. | 417/477 H |
| 5,256,041 | 10/1993 | Tucker | 417/477 H |

FOREIGN PATENT DOCUMENTS

| | | | |
|---|---|---|---|
| 0569875 | 11/1993 | European Pat. Off. | 417/477 R |
| 3-26887 | 2/1991 | Japan | 417/477 |
| 2076068 | 11/1981 | United Kingdom | 417/477 |
| 2190145 | 11/1987 | United Kingdom | 417/477 |
| 9322560 | 11/1993 | WIPO | 417/477 A |

*Primary Examiner*—Richard A. Bertsch
*Assistant Examiner*—Peter Korytnyk
*Attorney, Agent, or Firm*—Flynn, Thiel, Boutell & Tanis

[57] ABSTRACT

A peristaltic pump includes a panel member having a rotatably driven rotor with roller elements on it, two projections which each have insert-receiving slots, two cover-supporting slots each extending away from a respective projection, and an orientation tab disposed between the projections. A one-piece insert has a platelike portion with ends slidably received in the insert-receiving slots, a recess which receives the orientation tab, and two pairs of aligned projections on opposite sides thereof, the insert further including a flexible tube extending around the rotor and having its ends engaging respective projections on one side of the platelike portion. A cover member is removably supported on the panel member by flanges which slidably engage the cover-receiving slots and by locking surfaces thereon which engage locking surfaces on the projections, the cover member including a curved surface adjacent and facing the roller elements on the rotor, and serving as a cover for the tube and rotor.

23 Claims, 3 Drawing Sheets

PERISTALTIC PUMP WITH ONE PIECE TUBING INSERT AND ONE PIECE COVER

FIELD OF THE INVENTION

The present invention relates to a peristaltic pump and, more particularly, to a peristaltic pump in which the fluid-conveying tube can be easily and rapidly replaced.

BACKGROUND OF THE INVENTION

A common type of known peristaltic pump has a rotatable rotor with a plurality of roller elements, a curved surface approximately concentric to the axis of rotation of the rotor, and a flexible tube which is compressed between the surface and rollers so that fluid is moved through the tube in response to movement of the roller elements relative to the surface. A removable cover is usually provided to enclose the tube and rotors in order to avoid insertion of a finger where it might be pinched or otherwise injured, and may have on it the curved surface. Although this known type of pump has been adequate for its intended purpose, it has not been satisfactory in all respects.

In particular, in any peristaltic pump of this type, the tube must be frequently removed from the pump for purposes of sterlization. Also, wear and tear on the tube due to continual operational flexing thereof results in a need to occasionally replace the tube. This normally means that screws or clamps must be manually removed in order to disengage the cover, additional screws and clamps must be undone to release the tube, a new tube must be painstakingly inserted, the ends of the new tube must be secured with screws or clamps, and then the cover must be reattached with screws or clamps. Obviously, it is relatively time consuming to manually remove or detach all of the screws and clamps and then later insert or reattach them, and usually requires a screwdriver or other tools which may not be readily available. Further, inserting the new tube can be relatively tedious and time consuming. Moreover, there is a risk that small parts such as screws or clamps may be lost or misplaced, making it difficult or impossible to fully and properly reassemble the pump to its original condition.

Accordingly, one object of the present invention is to provide a peristaltic pump in which the flexible tube can be easily and rapidly replaced, without any need for tools.

It is a further object to provide such a pump which has a minimum of parts, and which in particular has no small parts such as screws or clamps that can be lost or misplaced.

It is a further object to provide such a pump which has a minimum number of parts, and in which the parts are relatively simple and inexpensive to manufacture.

SUMMARY OF THE INVENTION

The objects and purposes of the invention, including those set forth above, are met according to one form of the present invention by providing a peristaltic pump which includes: a first member, an arrangement defining a surface at a predetermined location with respect to the first member, an arrangement supporting a plurality of elements on the first member for movement in succession along a path having a portion which passes near the surface, a second member removably supported on the first member and having an arrangement defining first and second passageways, and a flexible tube having first and second ends secured to the second member so that the first and second passageways respectively communicate with the first and second ends of the tube, the tube extending adjacent the surface and being resiliently compressed between the surface and each of the elements moving along the portion of the path of movement.

Another form of the present invention involves the provision of an insert for a peristaltic pump, which includes: a member having an arrangement defining first and second passageways, and a flexible tube having first and second ends secured to the member so that the first and second passageways respectively communicate with the first and second ends of the tube.

Still another form of the present invention involves the provision of a peristaltic pump which includes: a first member and a second member, the first and second members having structure thereon which facilitates a removable support of the second member on the first member, the second member having thereon a surface which is at a predetermined location with respect to the first member when the second member is removably supported on the first member, an arrangement supporting a plurality of elements on the first member for movement in succession along a path having a portion which passes near the surface when the second member is removably supported on the first member, and a flexible tube supported on the first member, the tube extending adjacent the surface and being resiliently compressed between the surface and each of the elements moving along the portion of the path of movement when the second member is removably supported on the first member.

BRIEF DESCRIPTION OF THE DRAWINGS

A preferred embodiment of the present invention is described in detail hereinafter with reference to the accompanying drawings, in which.

DETAILED DESCRIPTION

Figure 1:
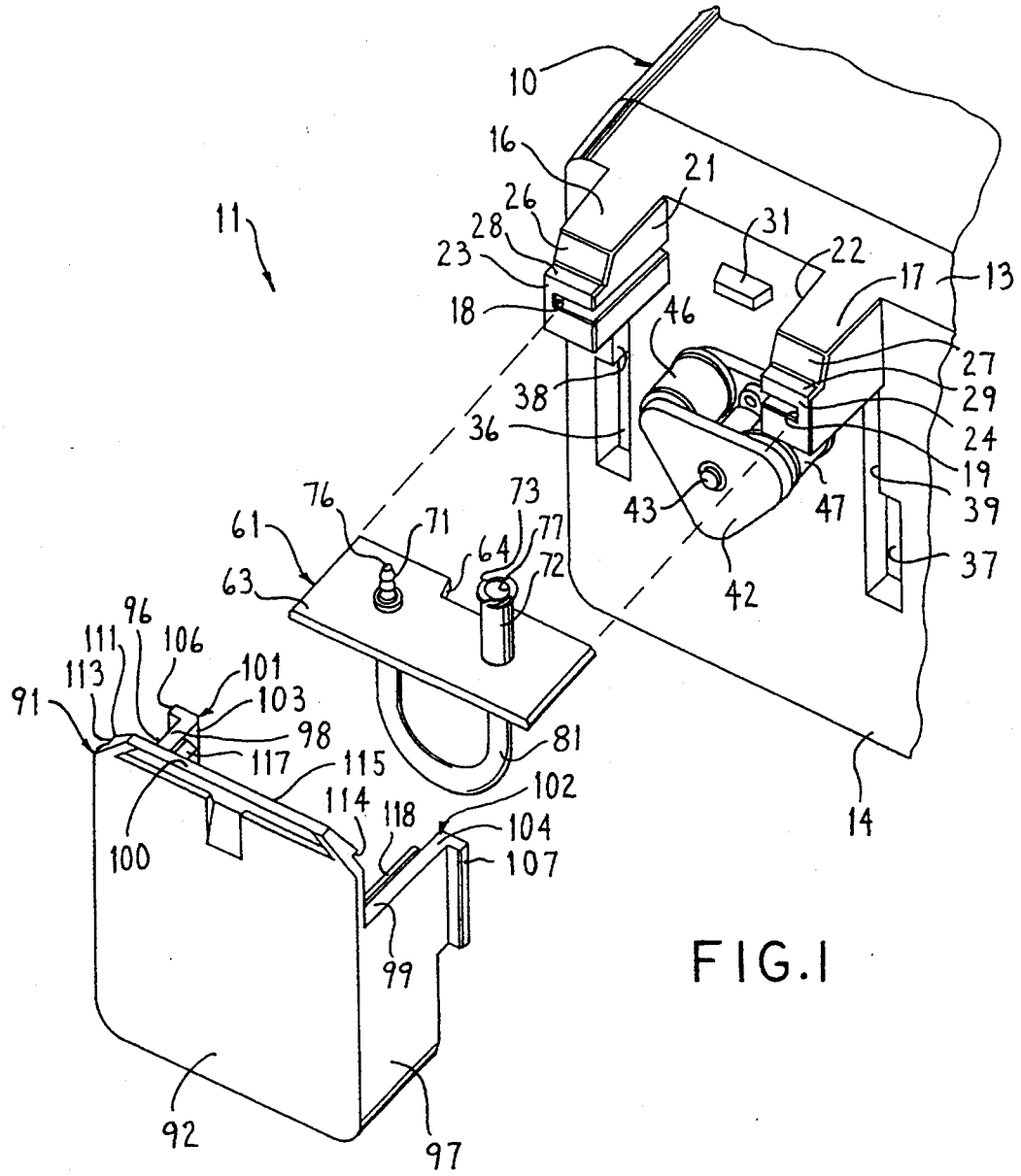
FIG. 1 is an exploded perspective view of a peristaltic pump which is part of a dental apparatus and which embodies the present invention.

FIG. 1 shows part of a dental apparatus 10, which includes a peristaltic pump mechanism 11 depicted in an exploded condition for clarity. In this dental application, the peristaltic pump is used to produce a flow of water or other irrigating fluid for purposes of rinsing the teeth of a patient. However, it will be recognized that the peristaltic pump according to the present invention is suitable for use in a wide range of other applications.

The dental apparatus 10 includes a front panel member 13 having a front surface 14, the panel member 13 including structure which is a part of the peristaltic pump. More specifically, panel member 13 has near an upper edge thereof two spaced and horizontally forwardly extending projections 16 and 17. Respective horizontal slots 18 and 19 are provided in the projections 16 and 17, each slot opening into the associated projection 16 or 17 from a surface 21 or 22 thereon which faces the other projection, and extending the full length of the projection from the outer end surface 23 or 24 thereof to the front surface 14 on the panel member 13.

Each projection has a recess 26 or 27 in the upper outer end, thereby defining upwardly facing locking surfaces 28 and 29 at the upper ends of the end surfaces 23 and 24. The front panel member 13 also has intermediate the projections 16 and 17 a horizontally outwardly projecting orientation tab 31, the tab being vertically aligned with the slots 18 and 19 and having a trapezoidal shape so that it tapers progressively in horizontal width in a direction toward its outer end.

The front panel member 13 also has two slots 36 and 37 which each extend vertically downwardly from a location adjacent a respective projection 16 or 17, and has two flanges 38 and 39 which each project into the upper portion of a respective one of the slots 36 and 37 from an outer edge of a side wall of the slot. Each of the flanges 38 and 39 has a width which is approximately half the width of the associated slot 36 or 37, a thickness which is substantially less than the depth of the slot, and a length which extends approximately half the length of the associated slot from the upper end of the slot.

A conventional and not-illustrated electric drive motor is mounted on the rear side of the front panel member 13 and has a rotatable drive shaft 43 which extends horizontally through an opening in the front panel member 13. The motor can be selectively actuated in a conventional and not-illustrated manner, for example using a conventional foot switch. A rotor 42 is non-rotatably mounted on the motor drive shaft 43 and has an approximately triangular shape with apexes which are rounded. Three roller elements 46–48 (FIGS. 1 and 3) are each supported at a respective apex of the rotor for rotation about a respective horizontal axis extending parallel to the drive shaft 43. As evident from FIG. 3, a peripheral edge portion of each roller element projects outwardly beyond the corresponding rounded apex of the rotor.

Referring again to FIG. 1, a disposable insert 61 includes a plastic plate 63 having an approximately rectangular shape and having in the middle of a longer side thereof an orientation recess 64 of trapezoidal shape. The opposite ends of the plate can be respectively slidably inserted into the slots 18 and 19 in the projections 16 and 17, the orientation tab 31 engaging the orientation recess 64 to ensure that plate 63 is not inserted with an inverted orientation, and the trapezoidal shape of tab 31 and recess 64 ensuring that there is no friction or interference between them as the plate 63 is inserted or removed.

Figure 3:
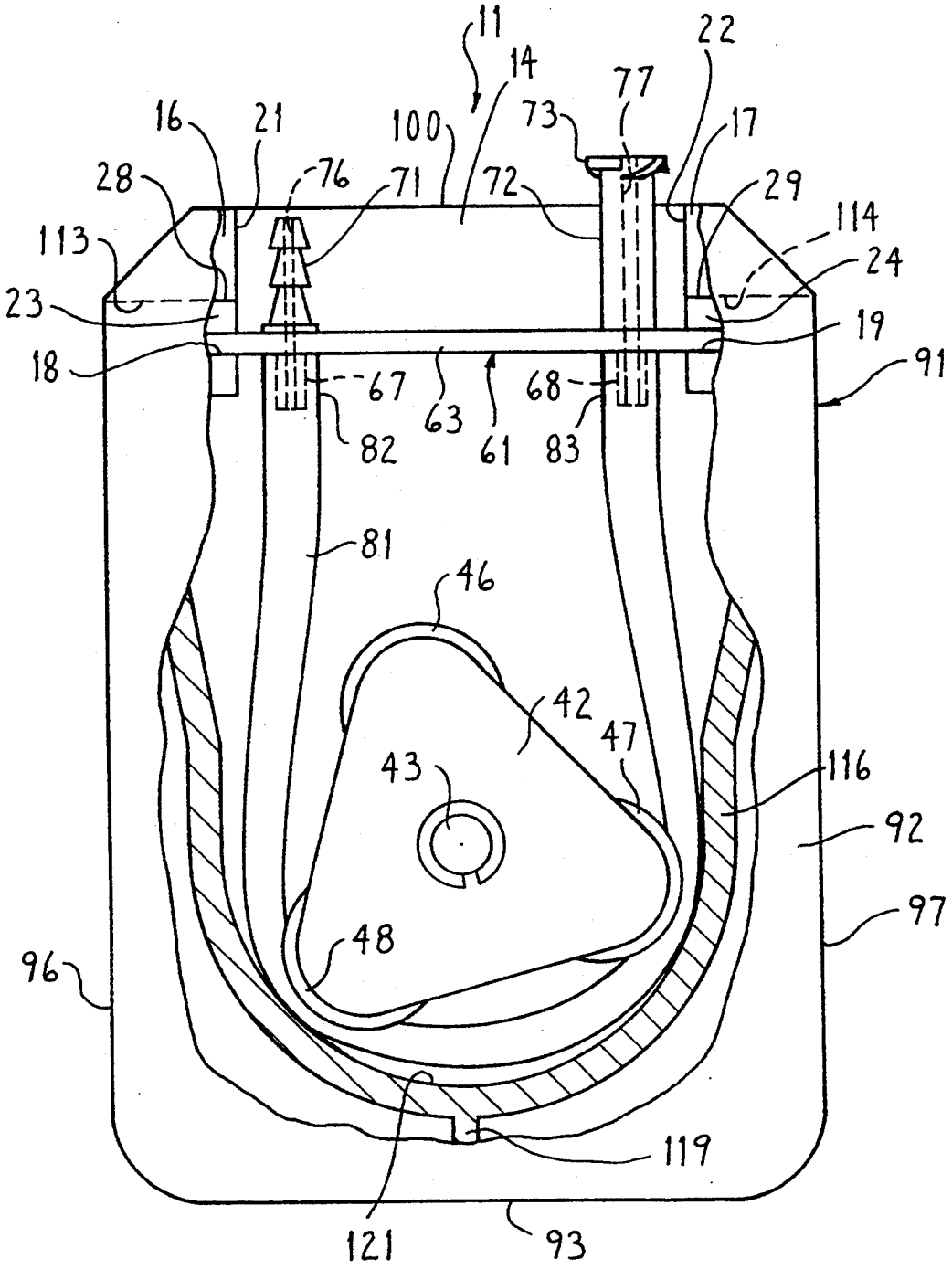
FIG. 3 is an elevational front view of the peristaltic pump of FIG. 1 with a portion of the cover cut away for clarity.

As best seen in FIG. 3, the plastic plate 63 has two spaced integral cylindrical projections 67 and 68 extending downwardly from an underside thereof. A further projection 71 with circumferential ribs projects upwardly from an upper side thereof and is coaxial with the projection 67, and a further cylindrical projection 72 extends upwardly from the upper side of plate 63 coaxial with projection 68, the projection 72 having at its upper end a connection flange 73. A passageway 76 extends centrally through projections 71 and 67 and plate 63, and a passageway 77 extends centrally through projections 68 and 72 and plate 63. In the preferred embodiment, the plate 63 and projections 67, 68, 71 and 72 are all respective portions of a single integral plastic part made by injection molding techniques.

The disposable insert 61 also includes a flexible plastic tube 81, the cylindrical projections 67 and 68 on the underside of plate 63 each extending into the central opening through the tube at a respective end 82 or 83 of the tube, so that the passageways 76 and 77 are each in fluid communication with the central opening through the tube. The ends of the tube are preferably secured to the projections 67 and 68 by a suitable conventional adhesive, which prevents the ends 82 and 83 of the tube from sliding off the projections 67 and 68 as a result of fluid pressure, and which creates a seal that effectively prevents fluid leakage at either end 82 or 83 of the tube. 10 Although the projections 67 and 68 in FIG. 3 are cylindrical, it will be recognized that they could alternatively have circumferential ribs or hose barbs similar to those on the projection 71, that a clamp could be used instead of an adhesive, and that the use of an adhesive or clamp is not necessarily essential.

Figure 2:
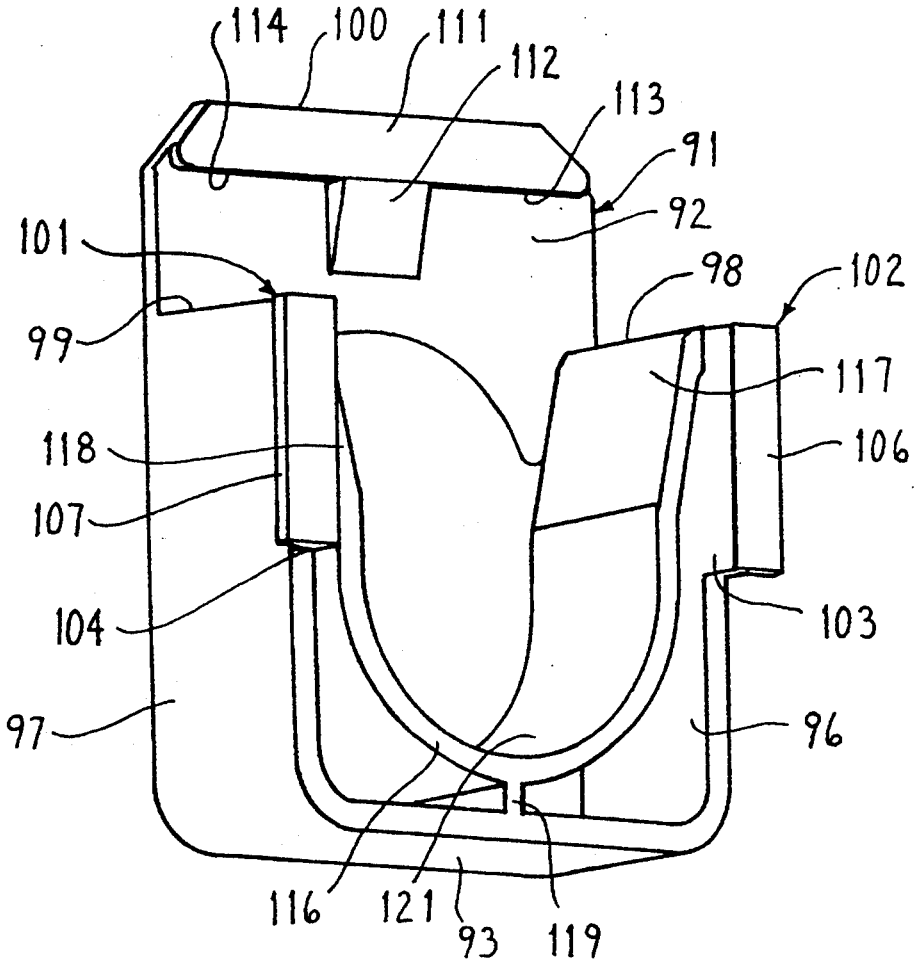
FIG. 2 is a perspective view of a cover which is an element of the pump of FIG. 1.

Referring to FIGS. 1 and 2, the pump 11 also includes a cover member 91, which in the preferred embodiment is a single integral part made of injection-molded plastic. The cover member 91 includes a vertically extending front wall 92 of approximately rectangular shape, a bottom wall 93 extending horizontally rearwardly from the lower end of the front wall 92 and two vertical sidewalls 96 and 97 which each extend rearwardly from a respective side of the front wall 92. The upper ends 98 and 99 of the sidewalls 96 and 97 are vertically lower than the upper end 100 of front wall 92. Each of the sidewalls 96 and 97 has near its upper rear end an L-shaped flange 101 or 102, each of which includes a leg 103 or 104 projecting rearwardly from tire upper end of a respective sidewall 96 or 97, and a further leg 106 or 107 projecting sidewardly from the outer end of leg 103 or 104.

Extending across the upper edge of the top wall, on the rear side thereof, is a locking rib 111 and a reinforcing rib 112 which extends downwardly from the center of the locking rib 111, the ribs 111 and 112 together forming approximately a T-shape. The locking rib 111 has on a rear side thereof an upwardly and forwardly inclined surface 115, and has on opposite sides of the reinforcing rib 112 respective downwardly facing locking surfaces 113 and 114.

A U-shaped wall 116 projects forwardly from the front wall 92 between the sidewalls 96 and 97, and has upper ends 117 and 118 which are each secured to a respective sidewall 96 or 97. A short connecting wall 119 extends vertically between the bottom wall 93 and the lowermost portion of the U-shaped wall 116. The U-shaped wall 116 has on its upper side an upwardly facing curved surface 121 of generally arcuate shape.

To removably connect the cover member 91 to the front panel member 13, the L-shaped flanges 101 and 102 on the cover member 91 are inserted into the lower ends of the slots 36 and 37 at a point below the flanges 38 and 39, and then the cover member 91 is moved upwardly so that the sidewardly projecting legs 106 and 107 slide behind the flanges 38 and 39, until the upper ends 98 and 99 of the sidewalls 96 and 97 are adjacent the underside of the projections 16 and 17. As the cover member 91 moves to this position, the inclined surface 115 on locking rib 111 engages the lower forward corners of the projections 16 and 17 and causes the upper portion of the front wall 92 of cover member 91 to flex forwardly, so that the locking rib 111 slides over the end surfaces 23 and 24 of the projections 16 and 17. As the upper ends 98 and 99 of the sidewalls approach the undersides of the projections 16 and 17, the locking rob 111 clears the ends of the projections 16 and 17 so that the resilience of the front wall 92 moves the locking rib 111 rearwardly to a position over the locking surfaces 28 and 29 on the projections 16 and 17. Consequently, the locking surfaces 113 and 114 on the cover engage the locking surfaces 28 and 29 on the projections in order to prevent downward movement of the cover.

To remove the cover, the upper end portion of the front wall 92 of cover member 91 is manually flexed forwardly in order to disengage the locking surfaces 113 and 114 on the locking rib 111 from the locking surfaces 28 and 29 on the projections 16 and 17, and then the cover member 91 is moved downwardly until the L-shaped flanges 101 and 102 reach the bottoms of slots 36 and 37, after which the cover member 92 is moved forwardly to withdraw the flanges 101 and 102 from the slots.

FIG. 3 shows the cover member 91 in its mounted condition. The upwardly facing curved surface 121 is spaced from and faces the drive shaft 43 of the motor substantially concentric thereto. The flexible tube 81 has its central portion extending adjacent the surface 121. The tube is pinched between the surface 121 and the roller elements 46–48 on the rotor 42 as the rotor 42 rotates, so that fluid is conveyed through the tube 81. The resilience of the tube acting on the surface 121 tends to urge the cover member 91 downwardly, but downward movement is limited by engagement of the locking surfaces 28 and 29 with locking surfaces 113 and 114. In other words, cooperation between the locking surfaces 28 and 29 and locking surfaces 113 and 114 determines the position of the curved surface 121 relative to the motor shaft 43 and rotor 42.

OPERATION

With reference to FIGS. 1 and 3, when the pump is assembled and operating, a dentist presses a not illustrated foot switch to selectively energize the motor and effect rotation of shaft 43 and rotor 42, which causes the roller elements 46–48 to successively move along a path of movement which includes an arcuate portion extending adjacent the curved surface 121, the compression of the tube 81 between the surface 121 and the moving roller elements 46–48 causing fluid to be conveyed through the tube 81.

Over time, due to natural wear and tear, it will become necessary to replace the tube 81. In order to do so, an operator first removes the cover member 91 in the manner described above, by manually flexing the upper end of front wall 92 forwardly and then moving the cover member 91 downwardly and then forwardly. The insert member 61 can then be removed by sliding the plate member 63 forwardly out of the slots 18 and 19, the tube 81 being removed with plate 63.

Then, an identical replacement insert 61 is slid into the slots 18 and 19 with the recess 64 facing the tab 31 so that tab 31 moves into recess 64. This ensures proper orientation of the insert member 61. In particular, if the insert member 61 were inadvertently inserted with a reverse orientation, the tab 31 would engage the side of the plate 63 opposite from the recess 64, thereby preventing the plate 63 from sliding fully into the slots 18 and 19. A portion of the plate 63 would then project outwardly beyond the end surfaces 23 and 24 on the projections 16 and 17. This in turn would prevent the cover member 91 from being attached to the front panel member 13, because the plate 63 would engage the upper end 100 of the front wall 92 and prevent the required upward movement of the cover member 91 to its operational position. Thus, the operator would quickly realize that the insert member 61 needed to be turned around.

After proper insertion of the plate 63, the tube 81 is manually positioned so that it extends around the rotor 42. Then, the cover member 91 is reattached the manner already described above.

Although a single preferred embodiment has been described in detail for illustrative purposes, it will be recognized that there are variations or modifications of the disclosed apparatus, including the rearrangement of parts, which lie within the scope of the present invention.

The embodiments of the invention in which an exclusive property or privilege is claimed are defined as follows:

1. A peristaltic pump, comprising: a first member, a surface carrying member including means defining a surface at a predetermined location with respect to said first member, means supporting a plurality of elements on said first member for movement in succession along a path which passes near said surface, a tube supporting member removably supported on said first member, and a flexible tube secured to said tube supporting member, said tube extending adjacent said surface and being resiliently compressed between said surface and each said element moving along said portion of said path of movement, said first member having first and second slots and respective projecting flanges which each project partially over one end of each said slot, wherein said surface carrying member has first and second L-shaped flanges each slidable disposed in a respective said slot at said one end thereof having said respective projecting flange so that said projecting flanges retain said L-shaped flanges in said slots, sliding movement of said L-shaped flanges lengthwise within said slots toward an opposite end of said slots causing said surface on said surface carrying member to move away from said movable elements.

2. A pump according to claim 1, including releasable locking means for releasably holding said surface carrying member in a position in which said L-shaped flanges are at said one end of said slots.

3. A pump according to claim 2, wherein said releasable locking means includes a first locking surface on said first member and, a second, locking surface on said surface carrying member and which is resiliently flexible between positions in which said first and second locking surfaces are engaged and disengaged.

4. A pump according to claim 3, wherein said surface carrying member is a single integral piece of molded plastic.

5. A pump according to claim 3, wherein said first member has further slots therein and said tube supporting member is at least partially slidably received in said further slots, and wherein said surface carrying member has a portion which prevents said tube supporting member from being slidably withdrawn from engagement with said further slots when said surface carrying member is in a position in which said L-shaped flanges are at said flanged ends of said first and second slots.

6. A pump according to claim 1, wherein said first member has projections which have respective further slots therein, said second member being slidably received in said further slots.

7. A pump according to claim 1, wherein said first member has further slots and tube supporting member is a platelike insert having opposite ends respectively disposed in said further slots of said first member, said platelike insert including spaced, tube connecting, hollow projections on one side of said platelike insert, each said hollow projection having a respective end of said tube sleeved thereon.

8. A pump according to claim 7, wherein said platelike insert includes further hollow projections provided on the other side of said platelike insert and respectively communicating with said tube connecting hollow projections, said platelike insert and said first mentioned and further hollow projections thereon being a single plastic part.

9. A pump according to claim 7, including a tab on one of said first member and insert and a recess in the other of said first member and insert, said recess being congruent with said tab with said insert removably supported on said first member.

10. A pump according to claim 1, wherein said surface carrying member comprises a cover member which has said surface thereon, said cover member being removably supported on said first member, said cover member having a portion serving as a cover for said tube and said elements.

11. A peristaltic pump, comprising: a first member and a cover member, said cover member being removably supported on said first member, said cover member having a surface which is at a predetermined location with respect to said first member when said cover member is removably supported on said first member, means supporting a plurality of elements on said first member for movement in succession along a path, said path being near said surface with said cover member removably supported on said first member, and a flexible tube supported on said first member, said tube extending adjacent said surface and being resiliently compressed between said surface and each said element moving along said path of movement with said cover member removably supported on said first member, said first member having first and second slots and respective projecting flanges which each project partially over one end of each said slot, said cover member having first and second L-shaped flanges each slidably disposed in a respective said slot at said one end thereof having said projecting flange so that said projecting flanges retain said L-shaped flanges in said slots, sliding movement of said L-shaped flanges lengthwise within said slots toward an opposite end of said slots causing said surface on said cover member to move away from said movable elements.

12. A pump according to claim 11, including releasable locking means for releasably holding said cover member in a position in which said L-shaped portions are at said one end, of said slots having said projecting flanges.

13. A pump according to claim 12, wherein said releasable locking means includes on said first member a portion with a locking surface thereon and includes on said cover member a portion which has a locking surface thereon and which is resiliently flexible between positions in which said locking surfaces are engaged and disengaged.

14. A pump according to claim 13, wherein said cover member is a single integral piece of molded plastic.

15. A peristaltic pump, comprising:

a first member rotatably supporting a peristaltic pump rotor and opposed slots adjacent said rotor, and a platelike insert fixedly carrying and extending substantially perpendicular to the plane of a generally U-shaped flexible tube and being rearwardly slidably inserted edgewise in said opposed slots in said first member so that said U-shaped tube partly surrounds said rotor;

a cover member fixed in front of said first member and inserted for covering id platelike insert and blocking forward movement of said platelike insert edgewise out of said opposed slots in said first member.

16. The pump of claim 15, including orientation means including a matching recess and protruding tab on said first member and an opposed edge portion of said platelike insert, said recess receiving said tab with the U-shaped tube properly trapped between said first member and cover member, said platelike insert blocking fixing of said cover member on said first member with said tab not received in said recess, receiving of said tab in said recess insuring proper flow direction through said tube upon rotation of said rotor.

17. The pump of claim 15 in which said recess and tab are trapezoidal so as to widen the mouth of said recess and guide said tab thereinto, said tab being on the front face of said first member and said recess being in the rear edge of said platelike insert.

18. An insert according to claim 15, wherein said recess is in a length edge of said platelike insert, said platelike member having laterally spaced first and second hollow tube connecting projection pairs, each projection pair integrally protruding from opposite sides of said insert, first and second passageways extending through the thickness of said platelike insert and through said first and second hollow projection pairs respectively, said platelike insert and its projection pairs being a one-piece molded plastic-unit.

19. A peristaltic pump, comprising:

a rotor supporting member having a front surface;

a rotor protruding from said front surface and rotatable in a plane parallel to said front surface and having an orbiting peripheral portion;

a peristaltic pumping tube unit comprising a tube mounting member and a u-shaped tube having a U-shaped mid-portion and end portions extending from opposite sides of said mid-portion to fixed engagement with said tube mounting member;

a cover having a concave U-shaped surface for firmly holding said U-shaped mid-portion of said U-shaped tube against said rotor peripheral portion in a peristaltic pumping position, namely a position for peristaltic pumping upon rotation of said rotor with respect to said U-shaped tube, said cover having a portion resiliently bendable with respect to said rotor supporting member, said cover and rotor supporting member integrally incorporating in one piece relation therewith cooperative releasable locking means of resilient snap fit type for precisely and fixedly locating said cover in a peristaltic pumping position on said rotor supporting member, said locking means being free of separate fasteners on said cover and rotor supporting member, said locking means being hand lockable and releasable without tools, said locking means including said resiliently bendable portion of said cover, said snap fit locking means including (1) ramp means on at least one of said cover and rotor supporting member slidable on ramp engaging means on the other of said cover and rotor supporting member for automatic resilient bending of said resiliently bendable portion of said cover with respect to said rotor supporting member during sliding of said cover on said rotor supporting member towards said peristaltic pumping position, and (2) step means ending said ramp means and ramp engaging means for snap fit locking of said cover in said peristaltic pumping position on said rotor supporting member, said cover and rotor supporting member integrally incorporating cooperative slide guide means for guiding said sliding of said cover on said rotor supporting member and therewith guiding movement of (1) said concave U-shaped surface of said cover toward said rotor and simultaneously (2) said locking means of said cover toward said locking means of said rotor supporting member.

20. The apparatus of claim 19 including means on said rotor supporting member and cover for fixedly trapping said tube mounting member therebetween, said cover and rotor supporting member enclosing said tube mounting member.

21. The apparatus of claim 19 in which said ramp means and step means on said cover are on said resiliently bendable portion of said cover, said ramp engaging means on said rotor support member protruding from said front surface of said rotor supporting member for bending said ramp means on said cover away from said rotor supporting member as said cover slides toward said peristaltic pumping position.

22. The apparatus of claim 21 in which the top edge of said cover is said resiliently bendable portion of said cover and tapered upward ramp-like to form said-ramp means, said step means of said cover being at the bottom edge of said ramp means, said step means of said rotor supporting member defining an upward facing surface on at least one protrusion extending forward from said front surface of said rotor supporting member.

23. The apparatus of claim 19 in which the slide guide means comprises guide slots in said front surface of said rotor supporting member flanking said rotor and flanges on said cover flanking said concave U-shaped surface, said flanges extending rearward from said cover to (1) insert in said guide slots in a direction substantially perpendicularly to said front surface and then (2) to slide along said guide slots substantially parallel to said front surface to bring said locking means of said cover into engagement with said locking means of said rotor supporting member.

* * * * *

UNITED STATES PATENT AND TRADEMARK OFFICE

CERTIFICATE OF CORRECTION

PATENT NO. : 5,433,588

DATED : July 18, 1995

INVENTOR(S) : David E. Monk, et al.

It is certified that error appears in the above-indentified patent and that said Letters Patent is hereby corrected as shown below:

Column 6, line 49; delete "," (first and second occurrence).

Column 7, line 2; after "and" insert ---said---.

line 56; delete ",".

Column 8, line 10; change "id" to ---said---.

line 45; change "u-shaped" to ---U-shaped---.

Column 10, line 9; change "said-ramp" to ---said ramp---.

Signed and Sealed this

Twenty-fourth Day of October, 1995

*Attest:*

Bruce Lehman

BRUCE LEHMAN

*Attesting Officer*

*Commissioner of Patents and Trademarks*